US008074958B1

(12) United States Patent
Hoy

(10) Patent No.: US 8,074,958 B1
(45) Date of Patent: Dec. 13, 2011

(54) LINTEL FORM FOR CONCRETE AND BLOCK CONSTRUCTIONS

(76) Inventor: John Hoy, Lake Placid, FL (US)

( * ) Notice: Subject to any disclaimer, the term of this patent is extended or adjusted under 35 U.S.C. 154(b) by 873 days.

(21) Appl. No.: 12/035,141

(22) Filed: Feb. 21, 2008

Related U.S. Application Data

(60) Provisional application No. 60/902,802, filed on Feb. 22, 2007.

(51) Int. Cl.
*E04G 13/04* (2006.01)

(52) U.S. Cl. ..... 249/19

(58) Field of Classification Search ..... 249/13, 249/18, 19, 26, 27, 28, 29, 30; 52/839, 846, 52/843

See application file for complete search history.

(56) References Cited

U.S. PATENT DOCUMENTS

| | | | | | |
|---|---|---|---|---|---|
| 1,101,484 | A | * | 6/1914 | Clark | 249/22 |
| 1,119,969 | A | * | 12/1914 | Longevin | 249/26 |
| 1,285,051 | A | | 11/1918 | Cramer | |
| 1,374,717 | A | * | 4/1921 | Bolton | 249/27 |
| 1,502,092 | A | * | 7/1924 | Duncan et al. | 249/29 |
| 1,502,323 | A | * | 7/1924 | Acher | 249/50 |
| 1,628,385 | A | * | 5/1927 | Bauer | 249/50 |
| 1,965,686 | A | * | 7/1934 | Bruce | 249/24 |
| 1,997,876 | A | * | 4/1935 | Sheldon | 52/839 |
| 2,218,705 | A | | 10/1940 | Faber | |
| 2,618,148 | A | | 11/1952 | Reed | |
| 3,224,154 | A | * | 12/1965 | Toti et al. | 52/520 |
| 3,341,991 | A | | 9/1967 | Dupre | |
| 3,376,011 | A | * | 4/1968 | Petchuk | 249/28 |
| 3,837,135 | A | | 9/1974 | Zachman | |
| 4,185,804 | A | * | 1/1980 | Baculo | 249/20 |
| 4,409,764 | A | | 10/1983 | Wilnau | |
| 4,580,388 | A | | 4/1986 | Maisch | |
| 4,646,496 | A | * | 3/1987 | Wilnau | 52/252 |
| 5,317,847 | A | | 6/1994 | Scairono | |
| 5,465,538 | A | | 11/1995 | Powers, Jr. | |
| 5,927,041 | A | | 7/1999 | Sedlmeier et al. | |
| 6,167,669 | B1 | * | 1/2001 | Lanc | 52/426 |
| 6,560,938 | B1 | | 5/2003 | Powers, Jr. | |
| 2003/0102421 | A1 | * | 6/2003 | Mertens | 249/33 |
| 2006/0179738 | A1 | | 8/2006 | Parrino et al. | |

* cited by examiner

*Primary Examiner* — Michael Safavi
(74) *Attorney, Agent, or Firm* — Mark D. Bowen, Esq.; Malin Haley DiMaggio Bowen & Lhota, P.A.

(57) ABSTRACT

A concrete lintel form includes a pair of elongate side members for installation in opposing face-to-face relation spanning a structure opening, such as a window or door opening, for fabrication of concrete beams or composite concrete masonry beams. Each form member comprises a generally vertical sidewall having inwardly projecting top and bottom legs running the substantially the entire length of the member. The top legs function to support masonry block stacked on top of the form to allow for the construction of a composite cast in place beam. The bottom legs function to support a bottom form that may be inserted after masonry has been stacked and secured with mortar, thereby allowing the workers to leave an opening that allows mortar droppings to fall through and not collect in the form. Each form member includes at least one outwardly projecting stiffener running substantially the entire length of the member between the top and bottom. The stiffener functions to resist outward expansion of the form as concrete is placed therein thereby minimizing bracing requirements.

6 Claims, 8 Drawing Sheets

LINTEL FORM FOR CONCRETE AND BLOCK CONSTRUCTIONS

CROSS REFERENCE TO RELATED APPLICATIONS

This application claims the benefit of provisional U.S. Patent Application Ser. No. 60/902,802, filed on Feb. 22, 2007.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to construction of beams over concrete masonry openings, and more particularly, to apparatus and methods for forming and constructing beams over openings in concrete or block constructions.

2. Description of Related Art

A lintel or header is a horizontal beam used in the construction of buildings, and is a major architectural contribution of ancient Greece. The beam usually supports masonry above a window or door opening.

There are generally four commonly employed methods of constructing a "beam" over a concrete masonry opening. The first method involves constructing a masonry beam which consists of concrete masonry units stacked over the opening, reinforced with steel, and then poured solid with concrete grout to from a composite masonry beam. The second method involves constructing a wood form system to contain a cast-in-place concrete beam above the masonry opening. The third method involves installing a precast concrete lintel over the masonry opening. The fourth method involves installing a stay-in-place lintel (steel or other material over the opening. Each of these four methods is burdened with significant drawbacks and disadvantages.

I. MASONRY BEAM

Masonry beams are constructed by placing a wood member (typically a 2×8 for 8" wide masonry) for the bottom form and supporting the bottom form from below with shoring. Next concrete masonry is stacked on top of the bottom form with steel reinforcement installed within the beam. The entire assembly is then grouted solid with concrete (grout) and left to cure thereby forming a beam above the opening. This method, however, has a number of drawbacks. First, mortar droppings have been found to accumulate on the bottom form potentially displacing concrete and decreasing the strength of the beam. Second, the bottom of the faun must be supported by shoring at each end and along the entire span of the beam, a time consuming and labor intensive requirement. Third, the complete concrete (grout) pour can not be inspected as the only areas that are visible after the pour are the top and bottom of the beam. Thus, any intermediate areas may contain voids that weaken the beam.

II. WOOD FORMED BEAMS

Wood formed beams are typically constructed with plywood forms for the beam sides and bottom. This construction requires the installation of bracing for the plywood sides and shoring of the bottom. The entire assembly is poured solid with concrete (grout) and left to cure, thereby forming a beam above the opening. A number of drawbacks are associated with this method. First, plywood forms must be discarded after their limited lifecycle due to repeated setting, pouring, and stripping thereby increasing material costs and labor costs associated with fabricating new forms. In addition, the entire form must be supported by shoring at each end and along the entire span of the beam to support the weight of the fond and concrete. Finally, plywood forms must be custom fabricated for each beam depth and span. As with other known methods this process is labor intensive and costly.

III. PRECAST CONCRETE LINTEL

Pre-cast concrete lintels are delivered to the jobsite and installed directly over the masonry opening. These lintels are typically either rectangular in shape or U-shaped. The rectangular lintels are typically an 8×8 rectangular beam (for 8" masonry) with internal rebar reinforcement. The U-shaped lintels are typically an 8×8 overall dimension (for 8" masonry) with internal rebar reinforcement. These lintels are combined with concrete masonry units stacked above and filled with grout to form a composite beam. The drawbacks associated with precast concrete lintel construction include excessive weight making theses lintels difficult to install. The typical weight of an 8×8 lintel is approximately 65 lbs. per lineal foot (plf), which translates to about 400 lbs. for a 6-foot long lintel. Similarly, the pre-cast U-shaped lintel is also heavy and thus difficult to install. The typical weight of an 8×8 U-shaped lintel is approximately 36 plf which translates to about 220 lbs. for a 6-foot long lintel. Another limitation of these lintels relates to load value. More particularly, load values for rectangular pre-cast lintels are limited by the depth of the member. Thus, the use of an 8" high lintel limits the load that the lintel can support.

Another drawback is that rectangular lintels are not easily incorporated into reinforced masonry structures. More specifically, these lintels are not manufactured to allow for the placement of grout at each side of the opening, nor are they manufactured to allow for a composite beam above. In addition, the complete concrete (grout) pour within U-shaped lintels is not subject for inspection as the only visible area after the pour is the top of the beam. Thus, any areas below the top may contain voids thereby weakening the beam. Further, mortar droppings within a U-shaped lintel may also create a deficiency in the beam's structural value. Finally, pre-cast lintel manufactures assign load values to their lintels and composite beams. These load values vary substantially. Thus, designers must take care when specifying precast lintels and be brand specific.

IV. STAY-IN-PLACE LINTEL

Stay-in-place lintels, typically consisting of steel, are delivered to the jobsite and installed directly over the masonry opening These lintels are typically manufactured from cold formed sheet or hot rolled steel sections (or other material)

which either forms the lintel itself or a composite of the two share with concrete masonry units and grout. The drawbacks associated with these lintels include the need to protect the steel by either painting or galvanization. In addition, some manufactures assign load values to their lintels and composite beams which forces designers to take care when specifying these lintels and be brand specific.

V. BACKGROUND ART

As a result of the problems faced in the art of lintel formation, the prior art reveals a number of attempts directed to providing advancements in lintel formation and construction. For example, U.S. Pat. No. 2,618,148, issued to Reed, discloses a composite beam structure of preformed concrete blocks with metal retaining members. U.S. Pat. No. 5,465,538, issued to Powers, Jr. a prefabricated lintel that is placed to span a doorway and a course of blocks is laid on the shoulders formed by the lintel, with a second course laid on the first course and a rebar positioned on the upper surface. A plurality of wire stirrups, each defining a rebar receiving loop, are engaged over the rebar and extend through openings in the two courses with end portions of the stirrups engaged in each of the holes defined in the upstanding legs of the lintel. The block openings are filled with grout.

U.S. Pat. No. 6,560,938, also issued to Powers, Jr., discloses a box lintel that includes an elongated, hollow metal form with a lower wall, integrally formed side walls extending upwardly therefrom, and integrally formed partial upper walls extending inwardly from the side walls. The form is adapted to be positioned on upright masonry supports so as to span an opening and to be filled with grout/mortar and to receive one or more courses of masonry bricks on the upper walls.

U.S. Pat. No. 4,409,764, issued to Wilnau, discloses a system for constructing the structural framework of a building or other structure of reinforced concrete using column and beam forms of sheet metal that remains in place as permanent parts of the framework after being filled with concrete. These forms are preferably factory-assembled, together with the necessary internal metal reinforcing skeletons, and shipped to the building site ready for erection of the column forms and interconnection thereof by the beam forms.

The references of the background art fail to overcome the significant limitations and disadvantages present in the formation of lintels in construction masonry constructions.

Accordingly, there exists a need in the art for an improved concrete construction lintel form and forming process. The present invention substantially departs from the conventional concepts and designs of the prior art, and in doing so provides a concrete lintel form and forming process that overcomes the limitations and disadvantages present in the art.

BRIEF SUMMARY OF THE INVENTION

The present invention overcomes the limitations and disadvantages in the art by providing an improved lintel form for use with masonry construction to provide a cavity for the formation of a poured concrete lintel. Additionally, the form can support concrete masonry block placed on top of the form prior to the placement of concrete (grout) pouring. This allows for one single pour in which the lintel is created. The forms are removed after the poured lintel has cured. Unlike prior art systems, the finished lintel is easy to inspect for voids. A form in accordance with the present invention is lightweight for ease of shipping and handling. Once on the job site, the form can be cut to a desired length and used. Once the beam has cured, the form may be removed and re-used.

A concrete lintel form in accordance with the present invention comprises a pair of elongate side members for installation in opposing face-to-face relation spanning a structure opening, such as a window or door opening to form a lintel form cavity. Each form member comprises a generally vertical side wall having inwardly projecting top and bottom legs running the substantially the entire length of the member. The top legs function to support masonry block stacked on top of the form to allow for the construction of a composite cast in place beam. The bottom legs function to support a bottom form that may be inserted after masonry has been stacked and secured with mortar, thereby allowing the workers to leave an opening that allows mortar droppings to fall through and not collect in the form. In addition, each form member includes at least one outwardly projecting stiffener running substantially the entire length of the member between the top and bottom. The stiffener functions to resist outward expansion of the form as concrete is placed into the form thereby minimizing bracing requirements. The form may be fabricated from extruded plastic or plastic blend, extruded aluminum or aluminum blend, or fiber reinforced polymer ("FRP"). In a preferred embodiment, the form is fabricated from FRP via a pultrusion process.

Accordingly, it is an object of the present invention to provide an improved concrete construction lintel form and forming process.

Another object of the present invention is to provide a lintel form that is light-weight for ease of shipping, handling, and installation.

Yet another object of the present invention is to provide a lintel form adapted to yield a composite cast-in-place beam or a typical cast-in-place concrete beam.

Still another object of the present invention is to provide a lintel form that yields such a cast-in-place beam capable of visual inspection.

Another object of the present invention is to provide a lintel form adapted to support a removable bottom.

Yet another object of the present invention is to provide a lintel form fabricated from pultruded FRP.

Still another object of the present invention is to provide a lintel form that is reusable.

In accordance with these and other objects, which will become apparent hereinafter, the instant invention will now be described with particular reference to the accompanying drawings.

BRIEF DESCRIPTION OF THE SEVERAL VIEWS OF TEE DRAWINGS

DETAILED DESCRIPTION OF THE INVENTION

Figure 1:
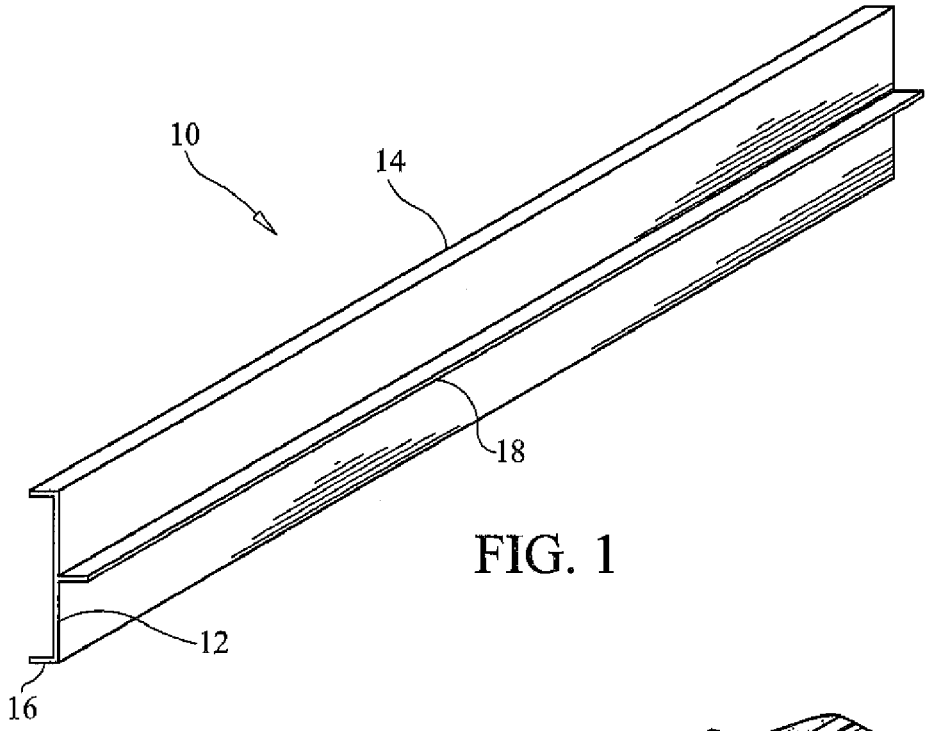
FIG. 1 is a perspective view of a lintel form member in accordance with the present invention.
Figure 2:
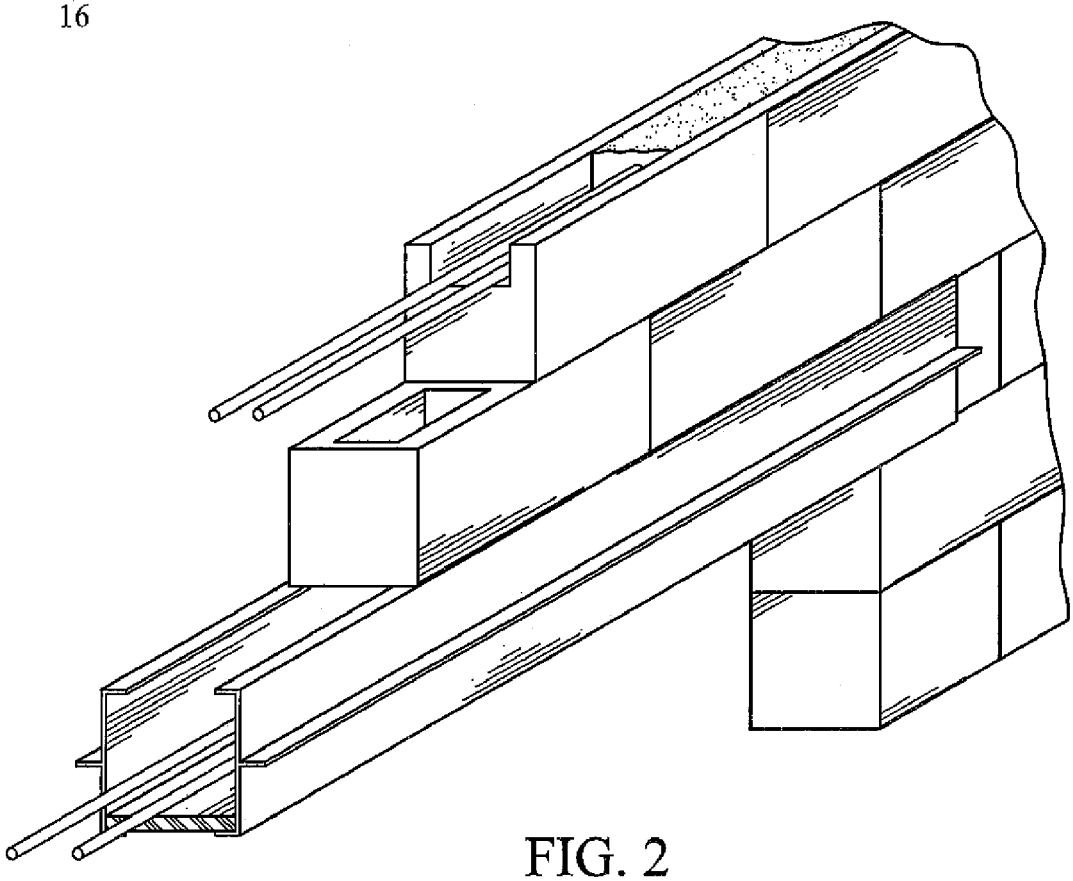
FIG. 2 is a perspective view of opposing lintel form members in position over an opening with rebar and stacked masonry blocks and grout to form a composite lintel.

With reference to the drawings, FIGS. 1-17 depict and illustrate an improved concrete lintel form, generally referenced as 10, in accordance with the present invention. As best seen in FIG. 1, lintel form 10 comprises a generally an elongate form member. Lintel form 10 is typically used as part of a pair of form members installed in opposing face-to-face relation spanning a structure opening, such as a window or door opening to form a lintel form cavity as illustrated in FIG. 2. Each form member 10 includes a generally vertical side wall 12 having inwardly projecting top and bottom support legs, referenced 14 and 16 respectively, running the substantially the entire length of the member. When a pair of form members 10 are disposed in face-to-face relation, the top legs 14 function to support masonry block stacked on top of the form to allow for the construction of a composite cast in place beam. The bottom legs 16 function to support a bottom form that may be inserted after masonry has been stacked and secured with mortar, thereby allowing the workers to leave an opening that allows mortar droppings to fall through and not collect in the form. In addition, each form member 10 includes at least one outwardly projecting stiffener 18 running substantially the entire length of the member and disposed between the top and bottom. Stiffener 18 functions to resist outward expansion of the form as concrete is placed therein thereby minimizing bracing requirements. In addition, top and bottom inwardly projecting legs 14 and 16 further function to increase rigidity by stiffening the bottom and top edges.

In a preferred embodiment, form members 10 are fabricated from fiber-reinforced polymer ("FRP") using a pultrusion process. Fabricating form members 10 from FRP provides a form that is sufficiently strong, lightweight, and durable such that the forms are capable of repeated use. The form members may, however, be fabricated from extruded plastic or plastic blend, extruded aluminum or aluminum blend, or fiber reinforced polymer ("FRP"), with out departing from the scope of the present invention.

Figure 3:
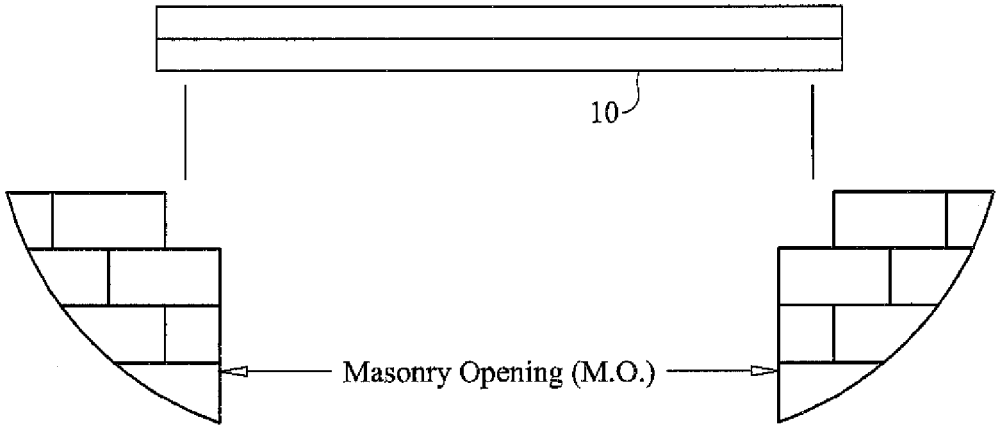
FIG. 3 is a side view depicting the lintel form in exploded relation with an opening formed in a block wall.
Figure 4:
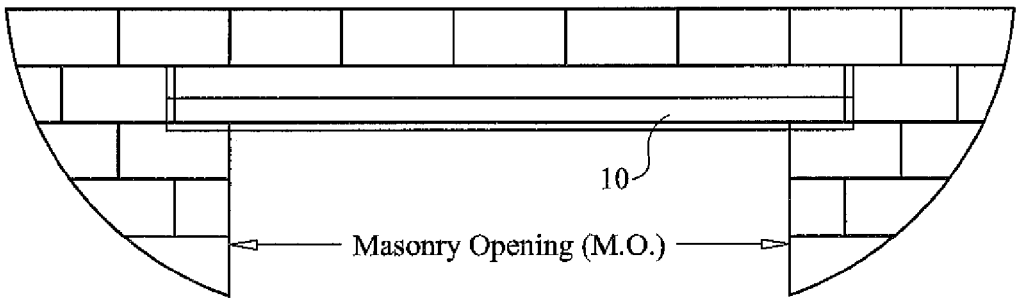
FIG. 4 is a side view depicting the lintel form in the operative position spanning the opening.

FIGS. 2-4 illustrate use of a lintel fault 10 in accordance with the present invention to form a beam spanning an opening in a masonry block wall. FIG. 3 shows form 10 in exploded relation above the opening in a masonry block wall, and FIG. 4 shows form 10 in operative position spanning the masonry block wall while further supporting additional blocks stacked on top thereof. As illustrated in FIGS. 3 and 4 the lintel form may be either fabricated or modified such that top and bottom legs 14 and 16 do not fully extend to the ends of the lintel faun so as to facilitate use of a single lintel form with masonry openings of varying size. As used herein, the term "block" shall primarily refer to concrete masonry blocks, but shall further include equivalent structures such as insulated concrete forms.

Figure 5:
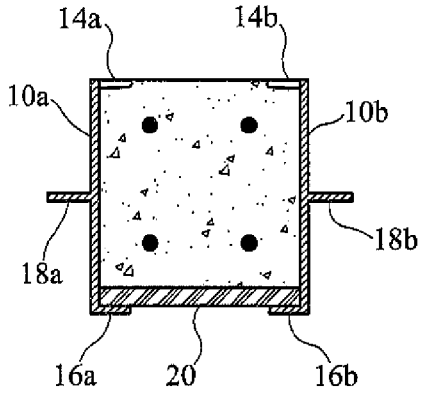
FIG. 5 is a cross-sectional view of the lintel form in use to construct a poured cast-in-place beam.
Figure 6:
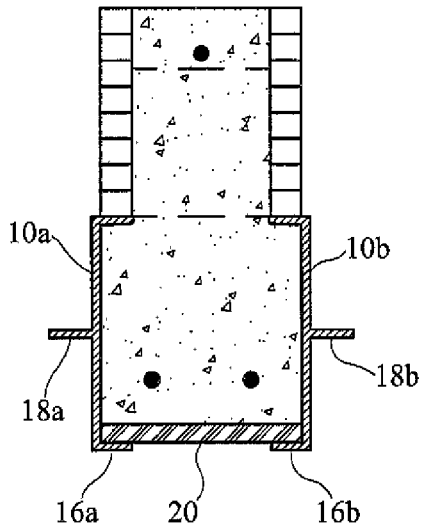
FIG. 6 is a cross-sectional view of the lintel form in use to construct a composite beam.
Figure 7:
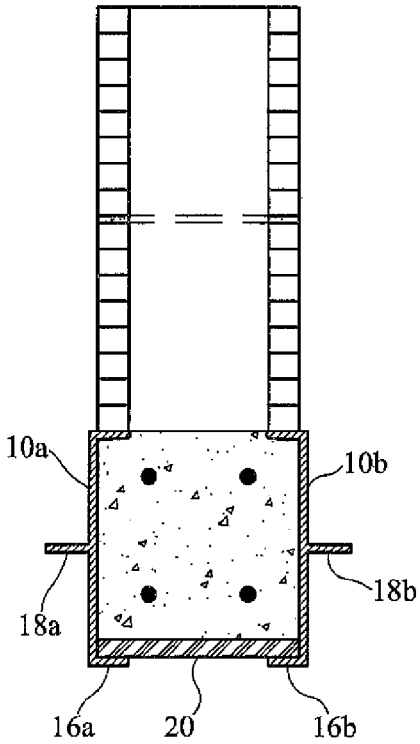
FIG. 7 is a cross-sectional view of the lintel form in use when forming a cast-in-place beam with masonry block stacked thereon.
Figure 8:
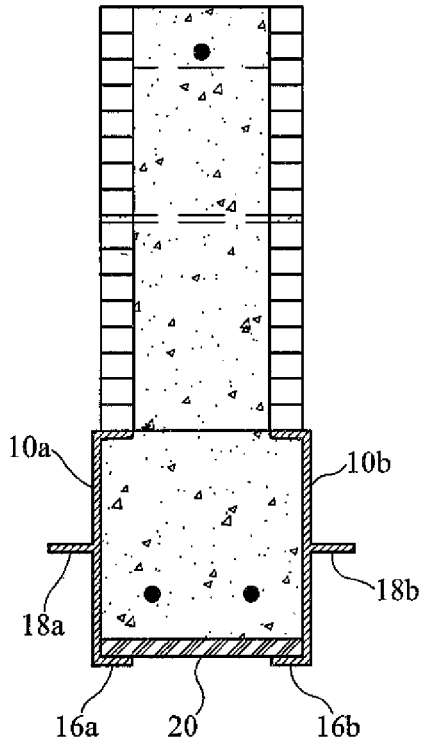
FIG. 8 is a cross-sectional view of the lintel form in use when forming a composite beam.

FIGS. 5-8 are cross-sectional views depicting the use of opposing lintel form members, referenced as 10*a* and 10*b*, to fabricate various lintel constructions. FIG. 5 depicts lintel form members 10*a* and 10*b* disposed in face-to-face relation spanning a masonry opening to from a cast-in-place reinforced concrete beam. Lower inwardly projecting legs 16*a* and 16*b* function to support a bottom form 20 that may comprise plywood, FRP, or any other suitable material. FIG. 6 depicts lintel form members 10*a* and 10*b* disposed in opposing face-to-face relation spanning a masonry opening to from a composite beam consisting of a cast-in-place beam having a single row of block on top thereof. In this application, top legs 14*a* and 14*b* function to support concrete blocks stacked on top of the lintel form. As discussed above, a significant advantage of the present invention relates to the ability to install concrete blocks on top of the form prior to inserting bottom form 20 such that mortar droppings are allowed to fall down through the form thereby avoiding the accumulation of mortar in the beam once formed. After the concrete blocks have been installed with mortar and rebar, bottom form 20 is put in position and concrete is placed from the top thereby forming a composite beam. FIG. 7 depicts lintel forms 10*a* and 10*b* disposed in face-to-face relation with upper legs 14*a* and 14*b* functioning to support concrete masonry stacked on top of a cast-in-place concrete beam. FIG. 8 depicts lintel form members 10*a* and 10*b* disposed in opposing face-to-face relation spanning a masonry opening to from a composite beam consisting of a cast-in-place beam having two rows of concrete-filled block on top thereof.

Figure 9:
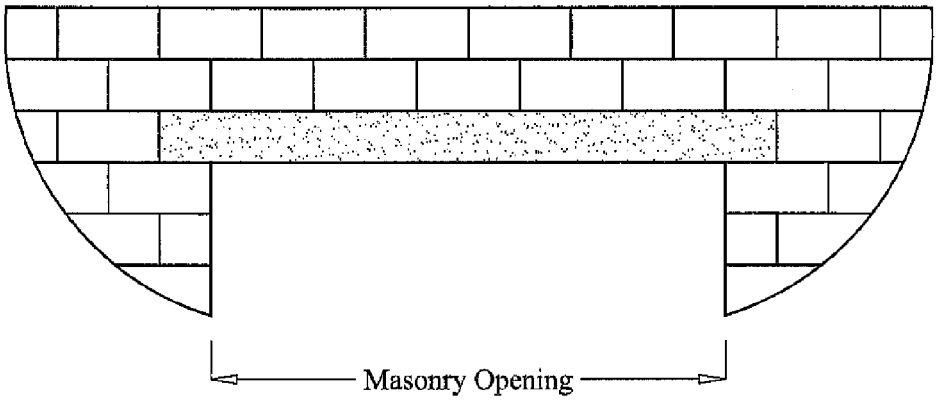
FIG. 9 is a side view of a cast in place concrete lintel constructed using the lintel form of the present invention to span a masonry opening.
Figure 10:
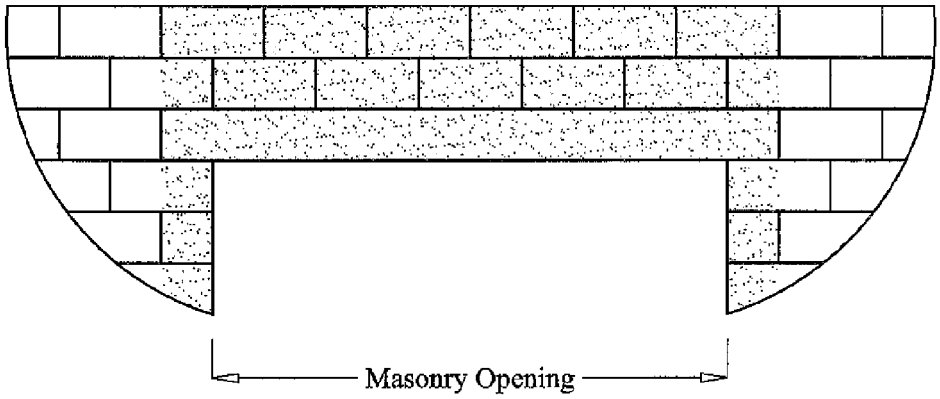
FIG. 10 is a side view of a composite concrete and masonry beam constructed using the lintel from of the present invention.

FIG. 9 is a side view depicting the a cast-in-place concrete lintel over a masonry opening formed using lintel form members 10*a* and 10*b* as seen in FIG. 7. FIG. 10 is a side view depicting a composite concrete and masonry beam over a masonry opening formed using lintel members 10*a* and 10*b* as seen in FIG. 8.

Figure 12:
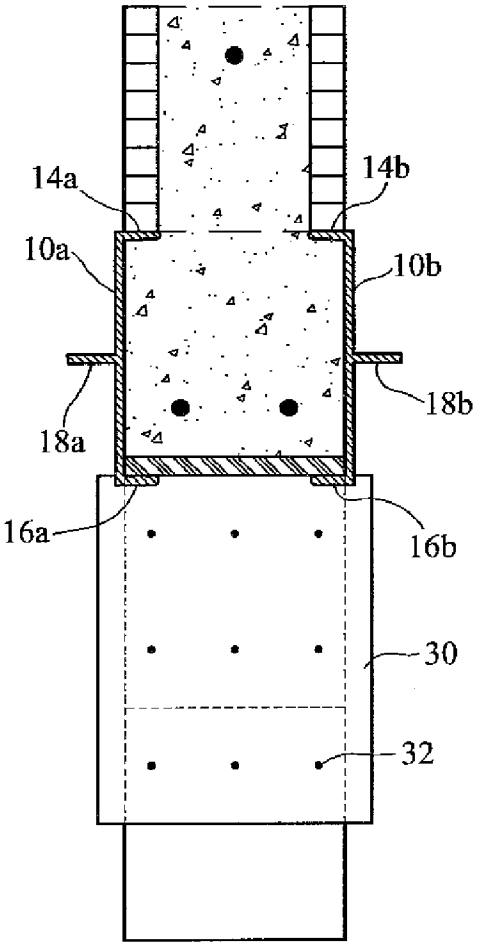
FIG. 12 is a front sectional view depicting the end support embodiment shown in FIG. 10.
Figure 11:
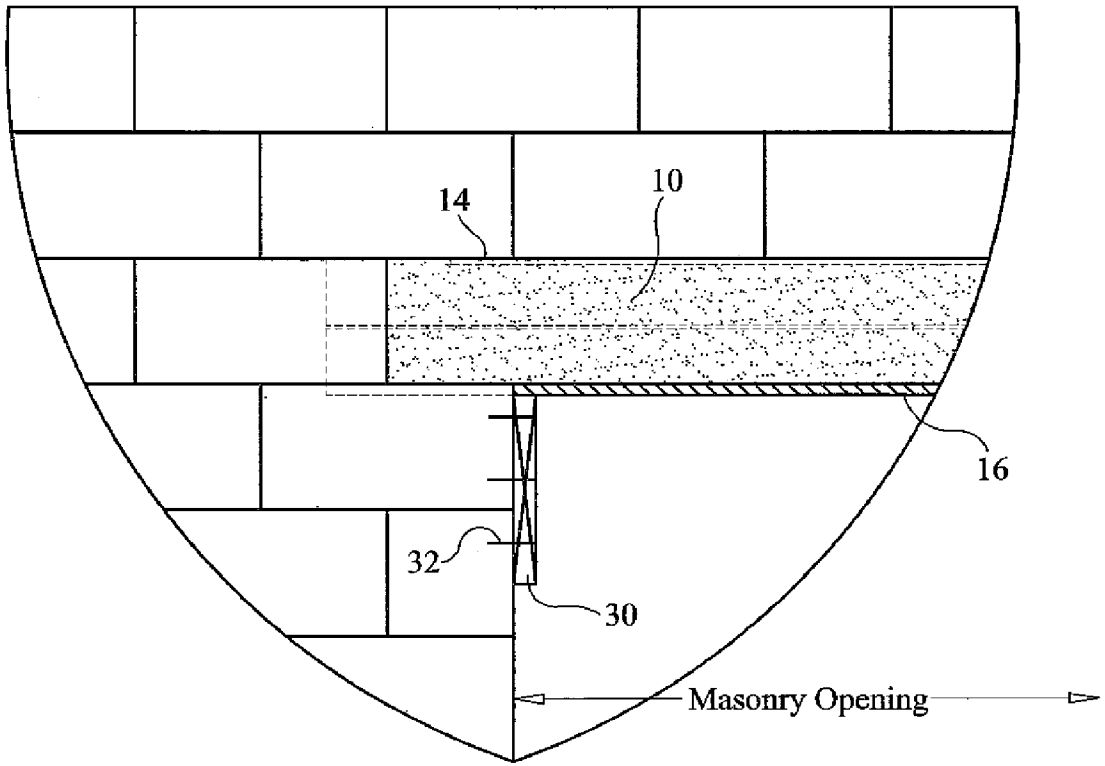
FIG. 11 is a side view detailing an end support embodiment for use with the lintel form of the present invention.

A further significant aspect of the present invention relates to providing support apparatus for the lintel form members. FIG. 11 is a partial side view illustrating use of a lintel form in accordance with the present invention to form a cast-in-place lintel. As best seen in FIG. 11, a lintel form member 10 is shown spanning a masonry opening Top leg 14 and bottom leg 16 are illustrated as having been cut-back so as to terminate short of the form member ends. Cutting back of top and bottom legs 14 and 16 functions to provide the ends of lintel form member 10 with a generally planar shape without the inwardly projecting legs thereby rendering the opposing ends of the lintel form suitable for abutting engagement with masonry block at the periphery of the opening. FIG. 11 further depicts a wood member, referenced as 30, fastened to the masonry block forming the opening using fasteners 32 to support the lintel form 10 as well as the end of bottom form 20. FIG. 12 is an elevational view thereof as seen from the interior of the masonry opening.

Figure 14:
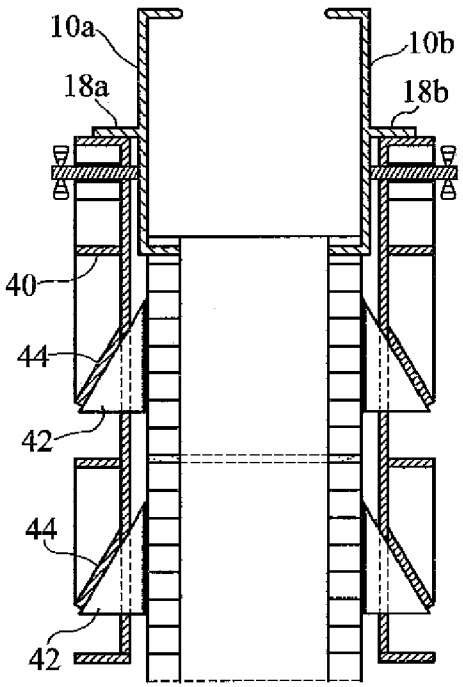
FIG. 14 is a front sectional view thereof.
Figure 13:
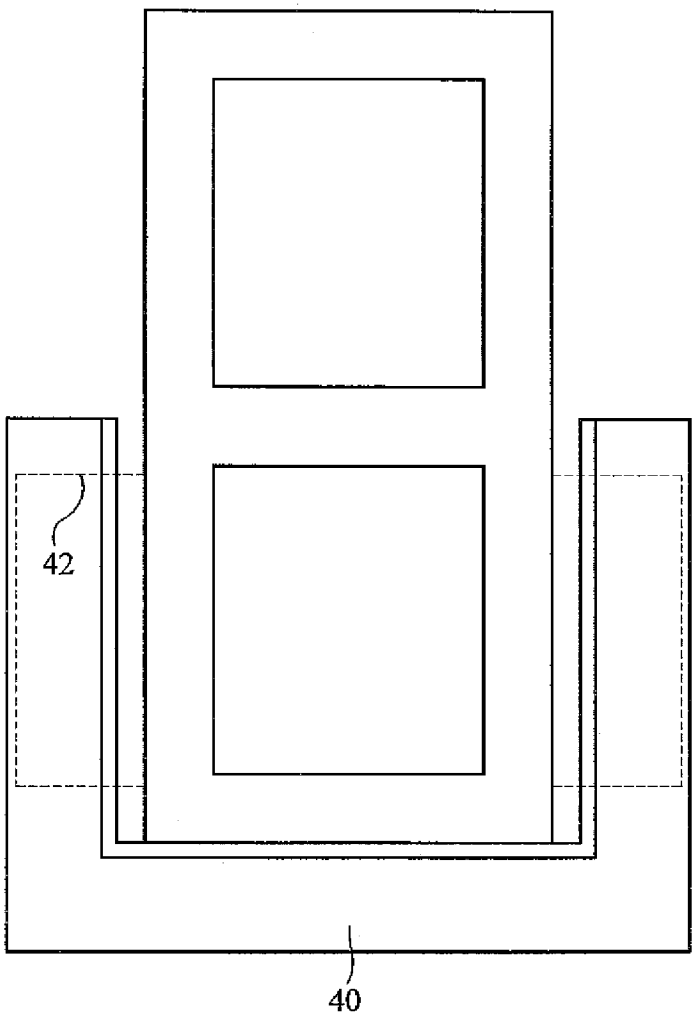
FIG. 13 is a top view depicting an alternate embodiment U-shaped clamp end support for use with the lintel form of the present invention.
Figure 15:
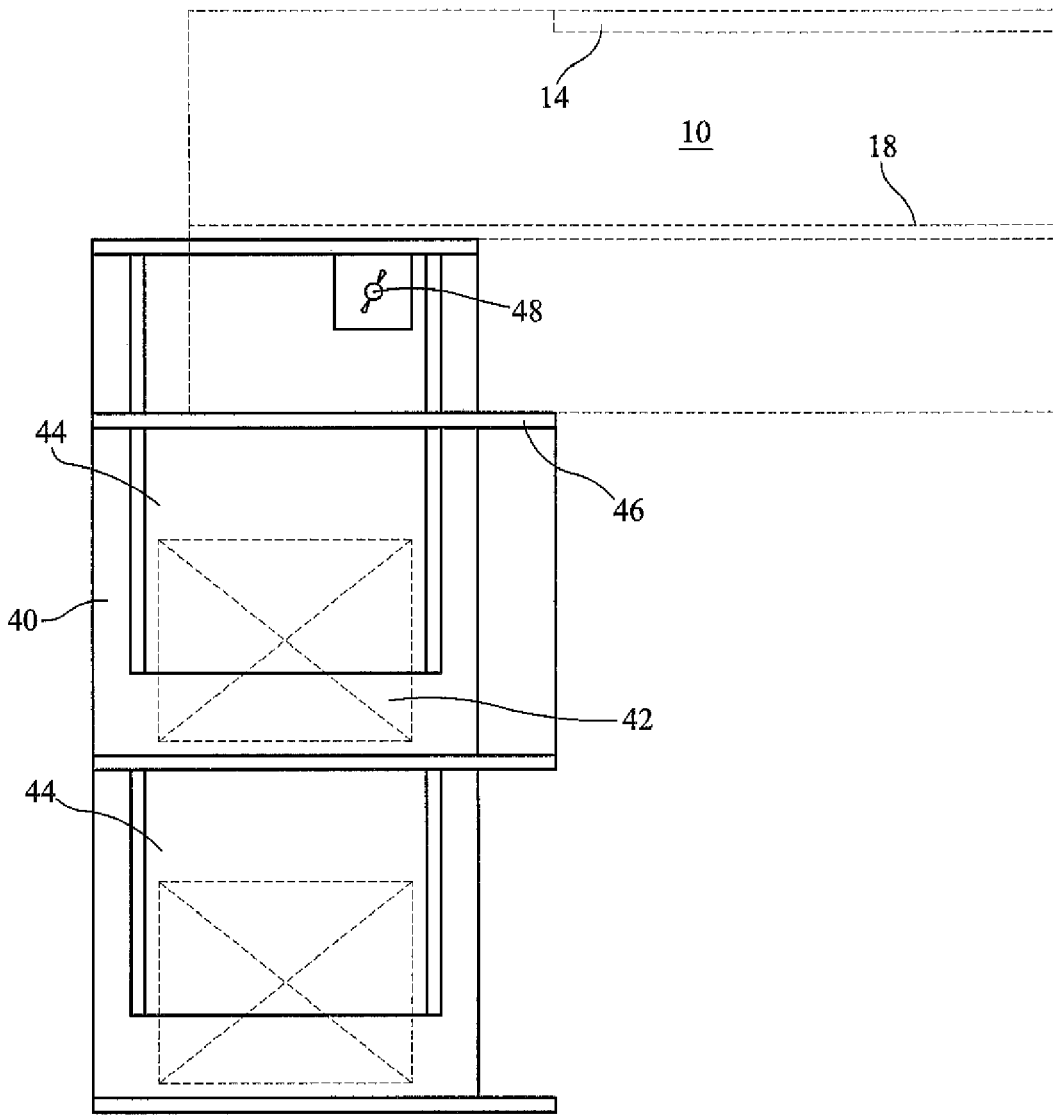
FIG. 15 is a side view thereof.

A further significant aspect of the present invention involves providing clamps for supporting lintel form members. FIG. 13 depicts a generally U-shaped support 40 that may be installed in supporting relation with lintel form members 10*a* and 10*b*. Support 40 may be positioned immediately below lintel form members 10*a* and 10*b* with a masonry block at least partially received therein and supported by wedge shaped blocks 42 as best seen in FIGS. 13-15. U-shaped support 40 thus includes support flanges 44 that project angularly downward for receiving wedge shaped blocks 42 as best seen in FIG. 14. The upper end of U-shaped support 40 is positioned in abutting supporting engagement with projecting stiffeners 18*a* and 18*b* on lintel form members 10*a* and 10*b* respectively. Horizontally projecting flanges 46 function to provide support to side forms 10 and bottom form 20. U-shaped clamp 40 further includes threaded clamp members 48 that function to further resist expansion or outward movement of the lintel form members 10*a* and 10*b*.

Figure 16:
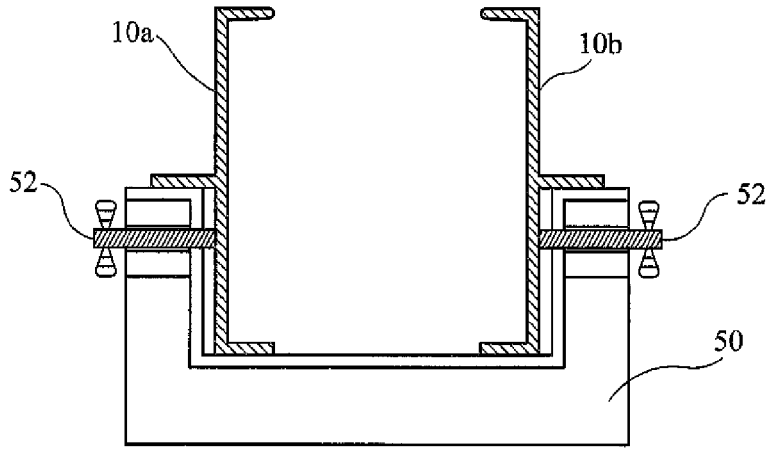
FIG. 16 is a cross-sectional detail view of a U-shaped clamp form shore support.
Figure 17:
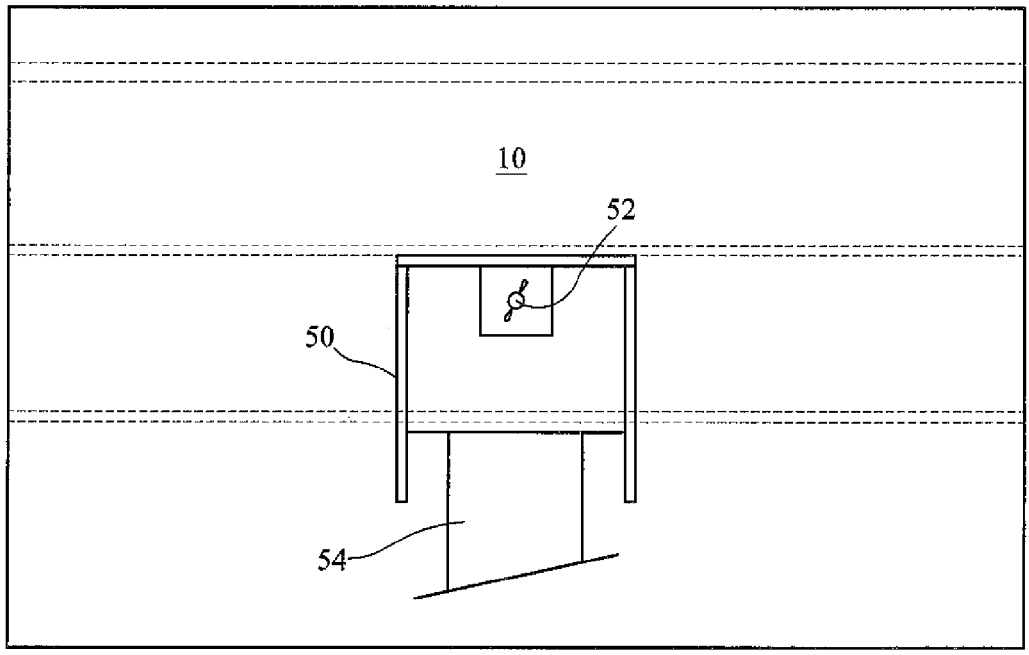
FIG. 17 is a side view thereof.

Yet another significant aspect of the present invention relates to providing shore support structure for mid span support. FIGS. 16-17 depict a U-shaped shore support 50 having lintel forms 10*a* and 10*b* supportedly received therein. As best seen in FIG. 16 shore support 50 functions to support lintel form members by engaging projecting stiffeners 18 as well as the bottom of members 10*a* and 10*b*. Shore support 50 includes opposing treaded screw clamps 52 for engaging form members 10*a* and 10*b* as best seen in FIG. 16. Shore support 50 is preferably supported from below by shoring 54 as seen in FIG. 17.

The instant invention has been shown and described herein in what is considered to be the most practical and preferred embodiment. It is recognized, however, that departures may be made therefrom within the scope of the invention and that obvious modifications will occur to a person skilled in the art.

I claim:

1. An apparatus for forming and constructing a lintel over an opening in concrete or block constructions, the opening defined between a first wall construction and a second wall construction, said apparatus comprising:

first and second elongate form members;

said first and second form members each including a generally planar vertical side wall having inner and outer surfaces terminating in opposing ends, each of said side walls including top and bottom support legs each projecting in an inward direction generally perpendicular to the corresponding side wall and extending substantially the entire length between said opposing ends;

said first and second form members each including an outwardly projecting stiffener extending substantially between said opposing ends;

means for removably securing said first and second form members with said inner surfaces generally disposed in face-to-face relation spanning the opening defined between the first and second wall constructions;

an elongate bottom form member sized for insertion between said first and second form members, said bottom form member supported by the inward projecting bottom support legs of said form members and substantially spanning the opening; and said first and second form members and said bottom form defining a lintel forming cavity whereby a flowable concrete received and contained therein cures thereby forming a lintel.

2. An apparatus for forming and constructing a lintel over an opening in concrete or block constructions according to claim 1, wherein said side wall top leg includes opposing ends terminating short of said side wall opposing ends.

3. An apparatus for forming and constructing a lintel over an opening in concrete or block constructions according to claim 1, wherein said side wall bottom leg includes opposing ends terminating short of said side wall opposing ends.

4. An apparatus for forming and constructing a lintel over an opening in concrete or block constructions according to claim 1, wherein said means for removably securing said first and second form members in face-to-face relation includes a U-shaped shore support.

5. An apparatus for forming and constructing a lintel over an opening in concrete or block constructions according to claim 1, wherein said stiffener comprises an elongate projecting member disposed on said vertical side wall and projecting therefrom is a second direction generally opposite of said first direction.

6. An apparatus for forming and constructing a lintel over an opening in concrete or block constructions, the opening defined between a first wall construction and a second wall construction, said apparatus comprising:

first and second form members terminating at opposing ends;

said first and second form members each including a generally planar vertical wall having inner and outer surfaces, each wall including integrally formed top and bottom support legs, said support legs projecting generally perpendicular from said inner surface;

said first and second form members each including an integrally formed, stiffener projecting from said outer surface and extending substantially between said opposing ends;

means for removably securing said first and second form members, with said inner surfaces generally disposed in face-to-face relation, spanning the opening defined between the first and second wall constructions;

an elongate bottom form member sized for insertion between said first and second form members, said bottom form member supported by the inward projecting bottom support legs of said form members and substantially spanning the opening; and whereby said first and second form members and said bottom form defining a lintel forming cavity whereby a flowable concrete received and contained therein cures thereby forming a lintel.

* * * * *